US005915769A

United States Patent [19]

Kidd

[11] Patent Number: 5,915,769

[45] Date of Patent: Jun. 29, 1999

[54] SELF-BAGGING WASTE COLLECTION DEVICE

[76] Inventor: Randall E Kidd, 14650 Rosholt Loop, Colorado Springs, Colo. 80921

[21] Appl. No.: 09/107,068

[22] Filed: Jun. 29, 1998

[51] Int. Cl.[6] ..... A01K 29/00; E01H 1/12

[52] U.S. Cl. ..... 294/1.4

[58] Field of Search ..... 294/1.1, 1.3–1.5, 294/55; 15/257.1, 257.3, 257.4, 257.7; 248/95, 99–101

[56] References Cited

U.S. PATENT DOCUMENTS

| | | | |
|---|---|---|---|
| D. 267,593 | 1/1983 | Crawford et al. | 294/1.4 |
| 3,659,891 | 5/1972 | Pettenon et al. | 294/1.4 |
| 4,146,259 | 3/1979 | Schultz | 294/1.4 |
| 4,279,437 | 7/1981 | Goldbarg | 294/1.4 |
| 4,349,224 | 9/1982 | Shiozaki | 294/1.4 |
| 4,457,549 | 7/1984 | Lowery | 294/1.4 |
| 5,799,993 | 9/1998 | Lafferty | 294/1.4 |

*Primary Examiner*—Dean Kramer

[57] ABSTRACT

A sanitary device for collecting and disposing of waste comprising an elongated handle with a rigid frame at the lower end. The frame supports a removable plastic bag. The bag and contents are disposed of when the collection procedure is completed. The bags used are typically the plastic bags with handles used in most grocery and other retail stores.

3 Claims, 4 Drawing Sheets

SELF-BAGGING WASTE COLLECTION DEVICE

BACKGROUND OF INVENTION

There are several waste collection device designs that will utilize a bag for collecting and disposing of waste; most require special or purchased bags. Many designs limit the full use of the bag opening. Most designs incorporate an opening that is parallel to the handle making it difficult to sweep/scoop material into the bag for disposal. This invention is to provide an economical means of collecting and disposing waste using bags with handles that are readily available from most grocery and other retail stores. This invention provides a secondary use for a bag that is typically discarded after it is emptied of contents purchased at retail outlets. This design optimizes the full opening of the bag. The bottom surface of the frame extends forward in a posture that eases waste collection so that any variety of implements such as a broom, rake, scoop, etc. can be used.

Figure 1:
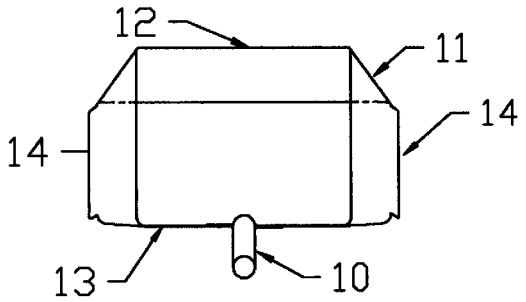
FIG. 1 is a top elevation view.
Figure 2:
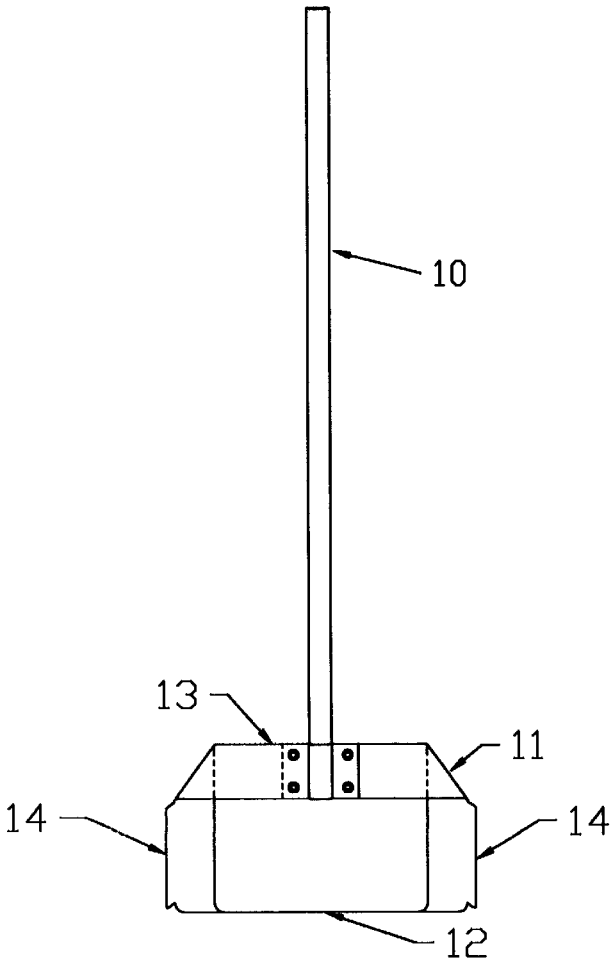
FIG. 2 is a back elevation view.
Figure 3:
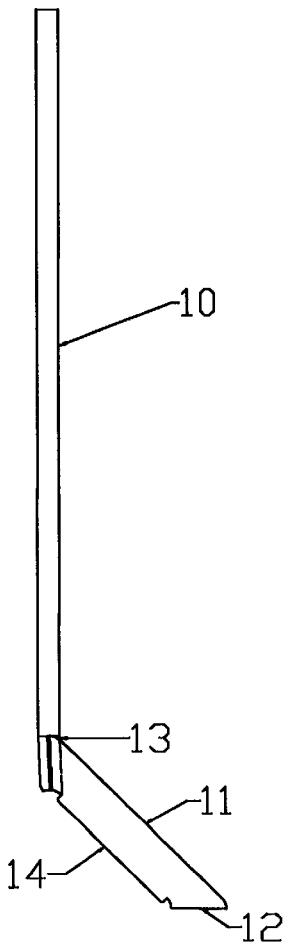
FIG. 3 is a left side elevation view, the right side being a mirror image of the left side shown.
Figure 4:
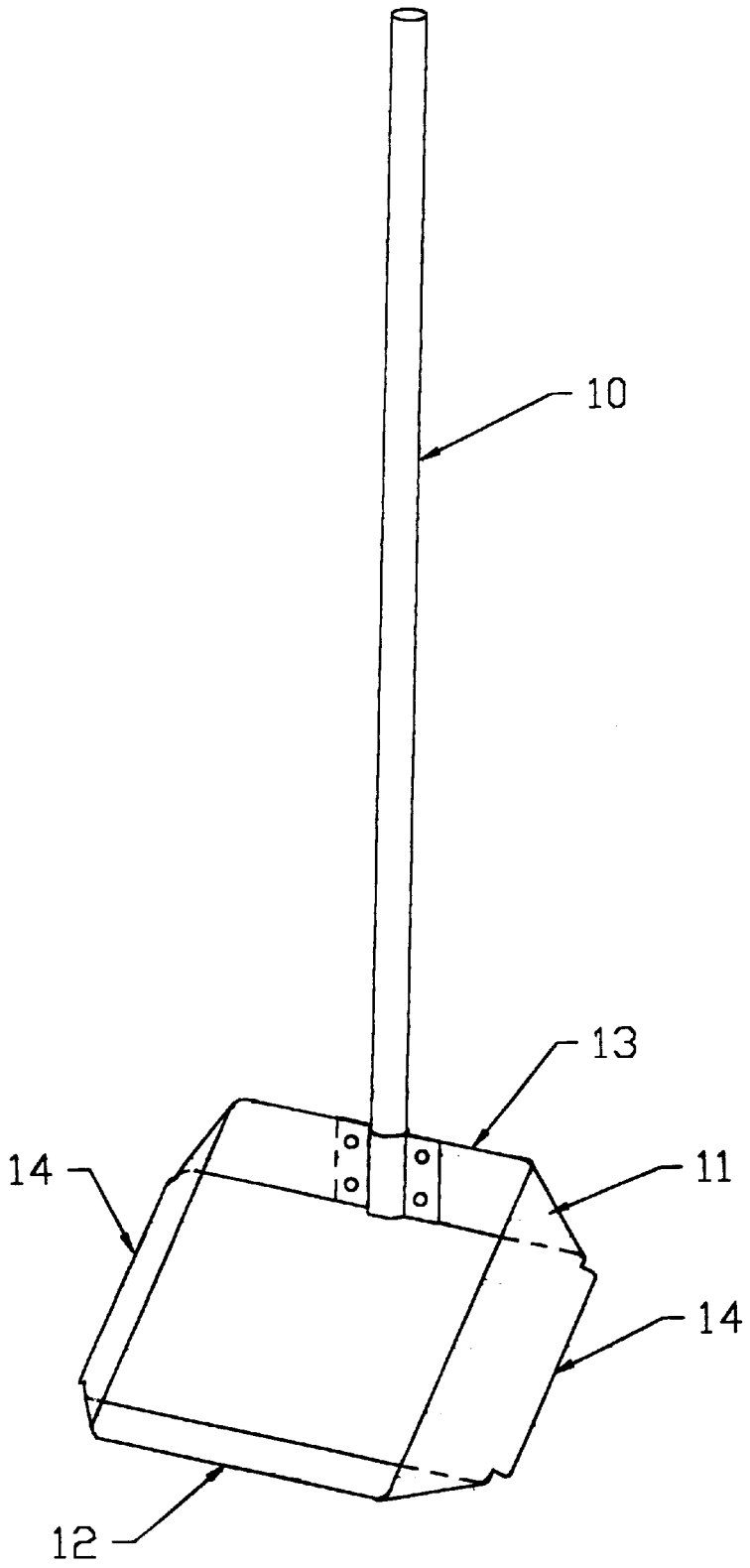
FIG. 4 is a perspective view taken from the top, front, and right side of a portable hand held bagging device showing my new design.
Figure 5:
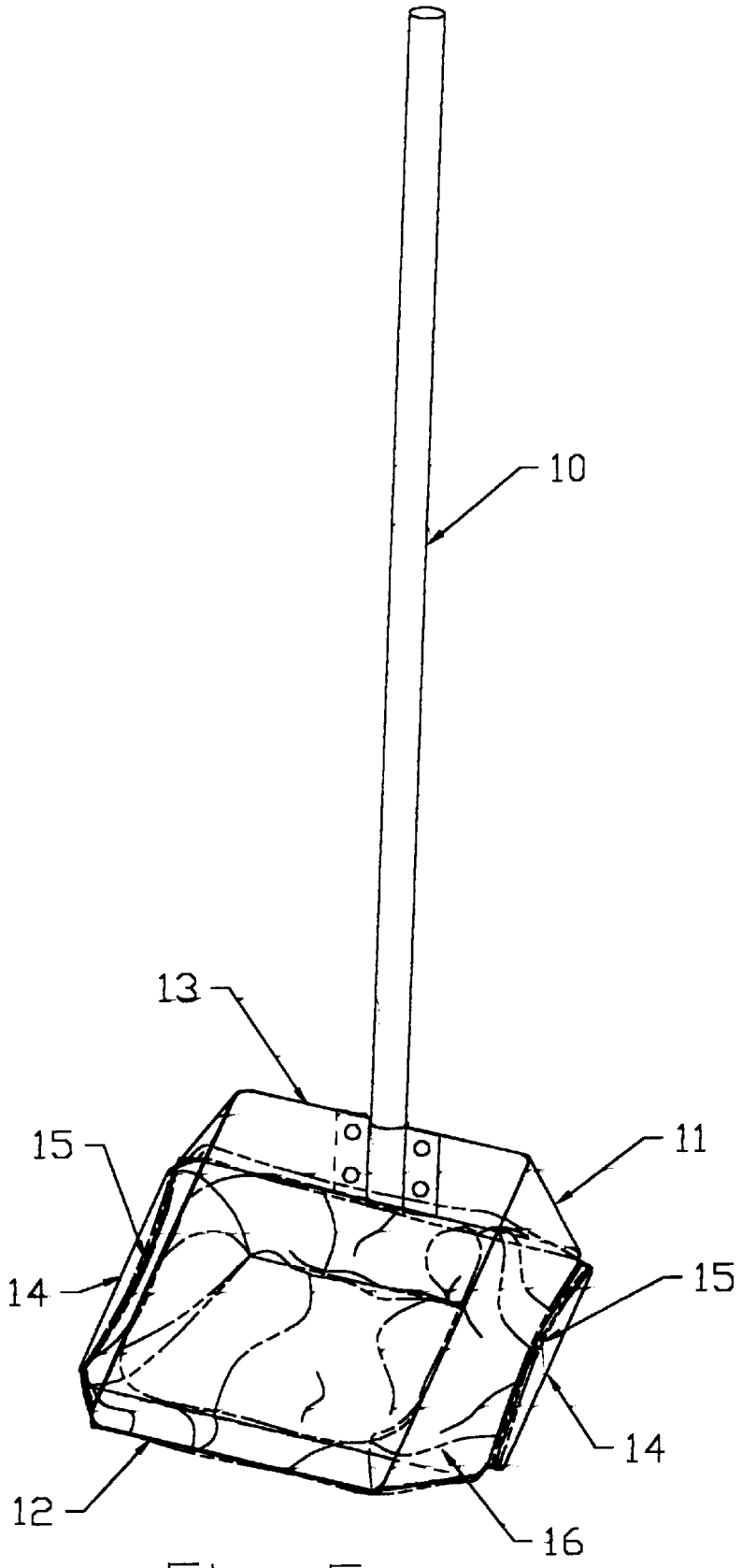
FIG. 5 is a perspective view of FIG. 4 with a bag attached.
Figure 6:
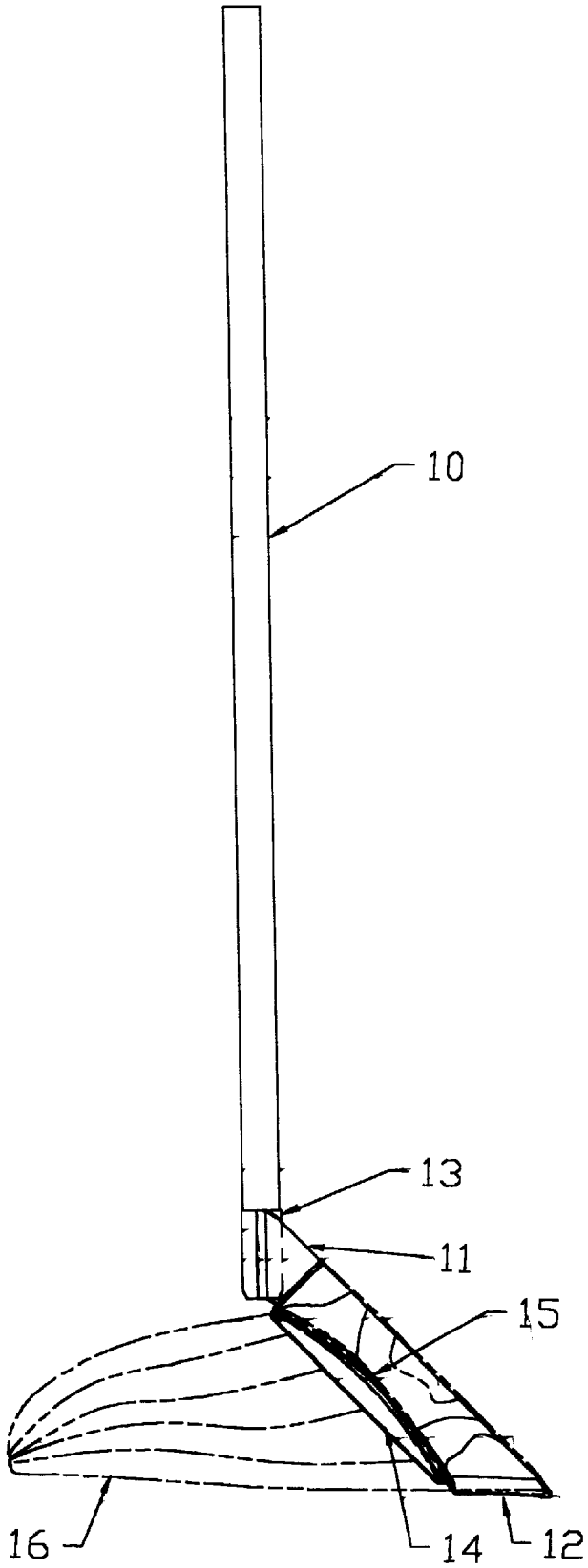
FIG. 6 is a left side elevation view of FIG. 3 with a bag attached.

The broken phantom lines, showing the outline, folds, and wrinkles of the trash bag in FIG. 5 and FIG. 6, is for the purpose of illustration only and forms no part of the claimed design.

DETAILED DESCRIPTION OF THE INVENTION

The self-bagging waste collection device of the present invention comprises an elongated handle 10 having a substantially rigid rectangular frame 11 disposed on one end thereof. The rectangular frame 11 extends the bottom forward from the handle 10. In the preferred configuration, complex angles from a straight flat material result in the bottom surface 12 extending forward of the handle to create an opening that better accommodates the collection of waste material. This design also creates a near perpendicular surface 13 to the bottom surface 12 in order to facilitate a simple and efficient method to mount the handle 10.

The rectangular frame 11 has a protrusion 14 on each of the sides to accommodate the bag handles 15 and secure the plastic bag 16 to the frame 11. The plastic bag 16 is pulled partially through the frame 11 opening, from the back, by the bag handle 15 end. The first the bag handle 15 attaches to the corresponding frame protrusion 14. The plastic bag 16 is then fitted and pulled around the bottom side of the bottom surface 12. The second bag handle 15 is then slightly stretched and attached to the corresponding frame side protrusion 14. In this attachment the plastic bag 16 remains firmly in place and will accommodate several pounds of waste. No special fittings or clamps are required.

I claim:

1. A waste collection device comprising: a rigid frame disposed on one end of an elongated handle, said frame forming a channeled rectangular form at the end of said handle; protrusions extend back, outwardly and are continuous extensions having at least a portion thereof being coplanar to side members of the frame, said protrusions defining a means for for attaching plastic bag handles to said frame whereby said attachment causes said plastic bag to stretch tautly over and around said frame to impede soiling of said frame from the waste being collected.

2. The waste collection device of claim 1 wherein the said rectangular channel is designed to extend the bottom surface of the said frame forward in an attitude that permits an easier means of sweeping or scooping waste through said frame and into the bag.

3. The waste collection device of claim 1 wherein the rectangular channel comprises a bottom surface that extends in a horizontal plane during use and a top surface that extends in a vertical plane during use.

* * * * *